United States Patent [19]

Bione

[11] 4,402,247

[45] Sep. 6, 1983

[54] INTEGRATED CIRCUIT GENERATING KEYING ENVELOPE SIGNALS

[75] Inventor: Angelo A. Bione, Elmhurst, Ill.

[73] Assignee: The Marmon Group Inc.

[21] Appl. No.: 303,245

[22] Filed: Sep. 17, 1981

[51] Int. Cl.[3] ..... G10H 1/057

[52] U.S. Cl. ..... 84/1.26; 84/1.13

[58] Field of Search ..... 84/1.11–1.13, 84/1.19–1.26

[56] References Cited

U.S. PATENT DOCUMENTS

| | | | |
|---|---|---|---|
| 4,201,105 | 5/1980 | Alles | 84/1.26 X |
| 4,212,221 | 7/1980 | Woron | 84/1.26 |
| 4,245,542 | 1/1981 | Woron | 84/1.26 |
| 4,267,763 | 5/1981 | Futamase et al. | 84/1.22 |

OTHER PUBLICATIONS

A. M. Davis, "Switched-Capacitor Techniques Implement Effective IC Filters," EDN Nov. 5, 1979, pp. 103–106 & 108.

*Primary Examiner*—Stanley J. Witkowski

*Attorney, Agent, or Firm*—Neuman, Williams, Anderson & Olson

[57] ABSTRACT

A multiplexed electronic organ utilizing a plurality of integrated circuit chips, each chip time division multiplexing selected keying envelope time constant signals from a switched capacitor time constant generator for two alphabetic notes over the entire frequency range of a spinet or for one alphabetic note over the entire frequency range of the manuals and pedals of a console organ. The same integrated circuit chip is used for both spinet or console organs. Each chip contains a multiplexer circuit which isolates the multiplexed keying envelope output signals from the time constant generator and includes as a coupling means a plurality of switching element arranged into groups. Some of the groups are interconnected to provide the keying envelope time constant signal normally intended for one frequency range to the output associated with a different frequency range.

9 Claims, 3 Drawing Figures

INTEGRATED CIRCUIT GENERATING KEYING ENVELOPE SIGNALS

BACKGROUND OF THE INVENTION

This invention is directed to electronic organs utilizing a plurality of integrated circuit chips, each chip time division multiplexing selected time constant signals from a switched capacitor time constant generator for two alphabetic notes over the entire frequency range of a spinet or for one alphabetic note over the entire frequency range of the manuals and pedals of a console organ thereby reducing the amount of circuitry and interconnection wiring; and, more particularly, to an integrated circuit package for generating time division multiplexed keying envelope signals for such time multiplexed electronic organs at a high rate of speed to maintain the frequency response characteristics.

Electronic organs are of two general varieties, the synthesis organ and the formant organ. In the synthesis organ, musical tones are synthesized by mixing properly scaled sine waves having frequencies representative of the fundamental and various harmonics of the tones to be synthesized. In formant electronic organs, so-called "bright waves" or signals which are rich in harmonic content including a fundamental frequency and a full complement of harmonics are filtered by formant filter circuits to remove unwanted harmonics and alter the harmonic balance of these complex signals to arrive at desirable tone signals.

Both types of electronic organs require keys or pedals to generate signals indicative of tones to be played by the organ. Various types of keying circuits, such as those disclosed in U.S. Pat. No. 3,636,231, are provided and controlled by the individual key or pedal signals to pass time constants signals which, in turn, activate tone generator circuits to generate the desired tones. In both synthesis and formant organs, it is advantageous to provide an arrangement for controlling the tone envelope, i.e., the rate of attack and decay of the tone signal, to avoid transients which introduce noise and also to achieve various desirable special effects. To achieve this purpose, each playing key drives a time constant circuit to impose upon the keying signal a defined envelope. The keying envelope signals which are generated by the organ playing keys or pedals in conjunction with the time constant circuits activate the keying circuits to provide such tone envelopes.

It is well known in the prior art to provide time division multiplexing of various information provided to the keying circuits, for example, draw-bar information, various control switches or tabs and the envelope keying signals. This information is divided into discrete repetitive time slots and provided to the keying circuits. A corresponding demultiplexer is provided at the output of the tone generator to distribute the audio signals among various filter circuits to ultimately provide the requested tones.

The standard in the prior art of electronic organs has been to generate the time constants necessary for the keying envelopes by utilizing the charging and discharging characteristics of a capacitor as part of a resistor capacitor (RC) time constant circuit. Recently developed switched capacitor techniques have overcome a major obstacle to the integration of time constant circuits, i.e., the implementation of resistors, by simulating resistors with high speed switched capacitors. This approach eliminates the necessity for precise integrated resistor values previously obtained only by hybrid devices that require costly trimming procedures.

Although the integration of time constant circuits utilizing switched capacitor techniques has greatly reduced the number of components and the size of those components included in electronic organs, the interconnection of the integrated time constant circuits into the remaining circuitry requires considerable wiring and does not take maximum advantage of the reduced size of the integrated time constant circuits.

SUMMARY OF THE INVENTION

The present invention overcomes the shortcomings of the prior art by providing an integrated circuit package for generating time division multiplexed keying envelope signals for time division multiplexed electronic organs in response to key-down signals and control signals. A total of six integrated circuits are needed for the entire spinet organ with each integrated circuit capable of operating over the entire range of a spinet for two alphabetic notes or a total of twelve integrated circuits are needed for the entire console organ with each integrated circuit capable of operating over the entire frequency range of a console for one alphabetic note. The integrated circuit package of the present invention comprises a plurality of integrated time constant circuits for receiving direct current input signals and generating keying envelope output signals, switch matrix means for receiving said key down signals and said control signals to generate the direct current input signals for the time constant circuits, and time division multiplexer means for multiplexing said keying envelope output signals at a high rate of speed and with complete isolation from the switched capacitance time constant generator.

In accordance with one aspect of the present invention, the integrated circuit package can be electrically configured for use in either a spinet or console electronic organ. Therefore, since the same package is used in both organs the large volume of packages purchased results in reduced cost per package.

BRIEF DESCRIPTION OF THE DRAWING

The invention will be better understood from the detailed description of the preferred embodiment when read with reference to the drawing in which.

DETAILED DESCRIPTION OF THE PREFERRED EMBODIMENT

Figure 1:
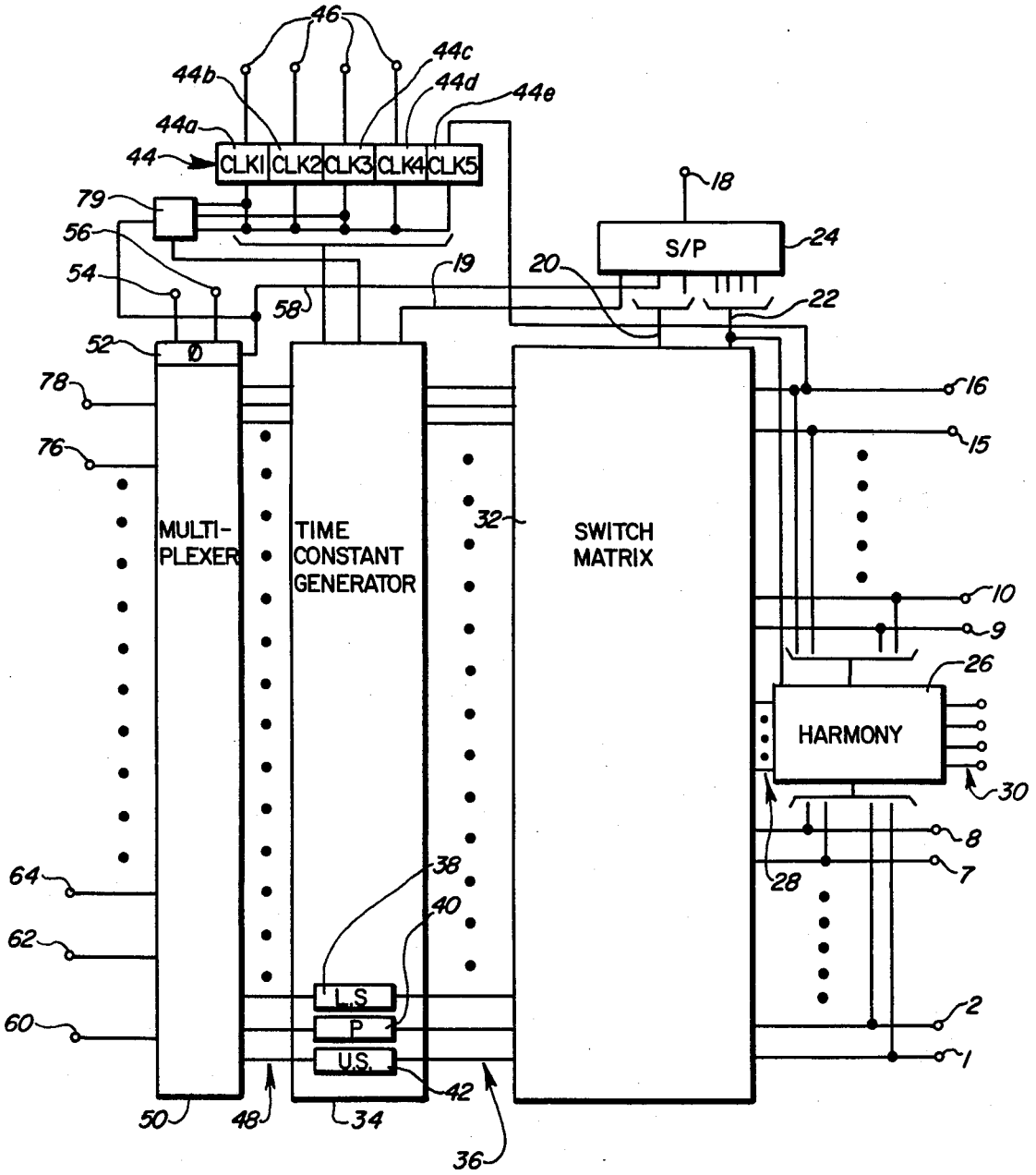
FIG. 1 is a block diagram of an integrated circuit package in accordance with the present invention.

FIG. 1 is a block diagram of an integrated circuit (IC) package for generating time division keying envelope signals in accordance with the present invention. Direct current (DC) input signals are provided from organ playing keys and pedals (not shown) on the input terminals 1 through 16 of the IC package shown in FIG. 1. Various control signals are provided via input terminal 18. The control signals are generated from either switches mounted on the organ console or internally within the organ as is well known in the art. In the preferred embodiment there are eight control signals which are converted into serial form and comprise a spinet/console mode signal, an upper manual to percussion signal, a lower manual to percussion signal, a harmony to percussion signal, harmony to upper manual sustain signal, an upper manual key down signal, a piano sustain signal and a pedal to lower manual signal are multiplexed into a series data stream to reduce the number of terminals required on the IC package. The serial data stream received on terminal 18 is converted to parallel control signals by the serial to parallel data converter 24 and those control signals are carried on the conductor 19 and the conductor groups 20 and 22.

The harmony circuit 26 receives inputs from the organ-playing keys connected to terminals 1 through 16 and also receives the control signals generated by the data converter 24 on the conductors of the conductor group 22 and generates output signals on the conductors 28. The conductors 30 of the harmony circuit 26 interconnect the harmony circuits from a plurality of IC packages to provide lock-out features between the various harmony circuits and to select the proper octave of upper manual notes for the harmony function. An embodiment of the harmony circuit 26 is completely described in application Ser. No. 226,117 filed on Jan. 19, 1981 by the inventor of the present application. Application Ser. No. 226,117 is assigned to the assignee of the present application and is incorporated herein by reference.

The switch matrix 32, in response to the signals applied to the terminals 1 through 16, the control signals on the groups of conductors 20 and 22 and the output signals from the harmony circuit 26 on the conductors 28 provides DC output signals to the envelope generator 34 via the conductors 36. The switch matrix 32 is a series of NAND/NOR type logic which address a particular key to a time constant circuit. This type of switch matrix or logic array is well known in art.

The envelope generator 34 comprises 24 time constant circuits divided generally into eight groups of three. The three time constant circuits making up each group are: a lower sustain time constant circuit 38 for generating a sustain envelope signal for lower manual keys; a percussion time constant circuit 40 for generating a percussion envelope signal selectively for upper or lower manual keys; and an upper sustain time constant circuit 42 for generating a sustain envelope signal for upper manual keys. One group of time constant circuits is provided for each pair of input terminals 1, 2; 3, 4; 5, 6; etc. The time constant circuits 38, 40, 42 use switched capacitor techniques and will be described hereinafter with reference to FIG. 2. The time constant circuits 38, 40, 42 are driven by clock phase circuits 44 to generate the various time constants required by the individual key down or harmony input signals. The clock phase circuits 44 are, in turn, driven by input clock signals received on terminals 16 and 46 from internal circuitry in the organ as is well known to one of ordinary skill in the art. The variety of input clock signals are of defined frequencies to provide the desired characteristics for the envelope signals generated by the envelope generator 34.

The output signals of the envelope generator 34 provided on output conductors 48 are keying envelope signals required by electronic organ keying circuits to generate desired tones. These keying envelope signals are time division multiplexed by the multiplexer 50 which is driven by time phase generator 52. The time phase generator 52 receives two time multiplexing signals on the input terminals 54 and 56 and a control signal from the data converter 24 on a conductor 58 of the conductor group 20. The multiplexer 50 provides time multiplexed output signals on its ten output terminals 60 through 78 (see FIG. 3). The output signals from the multiplexer 50 are connected to keying circuits to provide time multiplexed keying envelope signals for operation of those keying circuits in a time multiplexed electronic organ.

Time constant circuits have traditionally relied on the charging and discharging of a capacitor through one or more resistors to provide the desired rate of attack and rate of decay of a keying envelope signal. The implementation of precision resistors on integrated circuit chips has until recently prevented the integration of time constant circuits. Such integration is now possible by simulating precision resistors with high speed switched capacitors. For switched capacitor resistor simulation, a capacitor is alternately connected to two nodes to transfer discrete amounts of charge from the one node to the other. The equivalent value of simulated resistance of a switched capacitor is inversely proportional to the switching frequency. See, for example, the Nov. 5, 1979 issue of *EDN* magazine at pages 103 through 108 which is incorporated herein by reference. Thus, a range of attack and decay times can be provided by a switched capacitor time constant circuit by varying the frequency at which the capacitor is switched.

Figure 2:
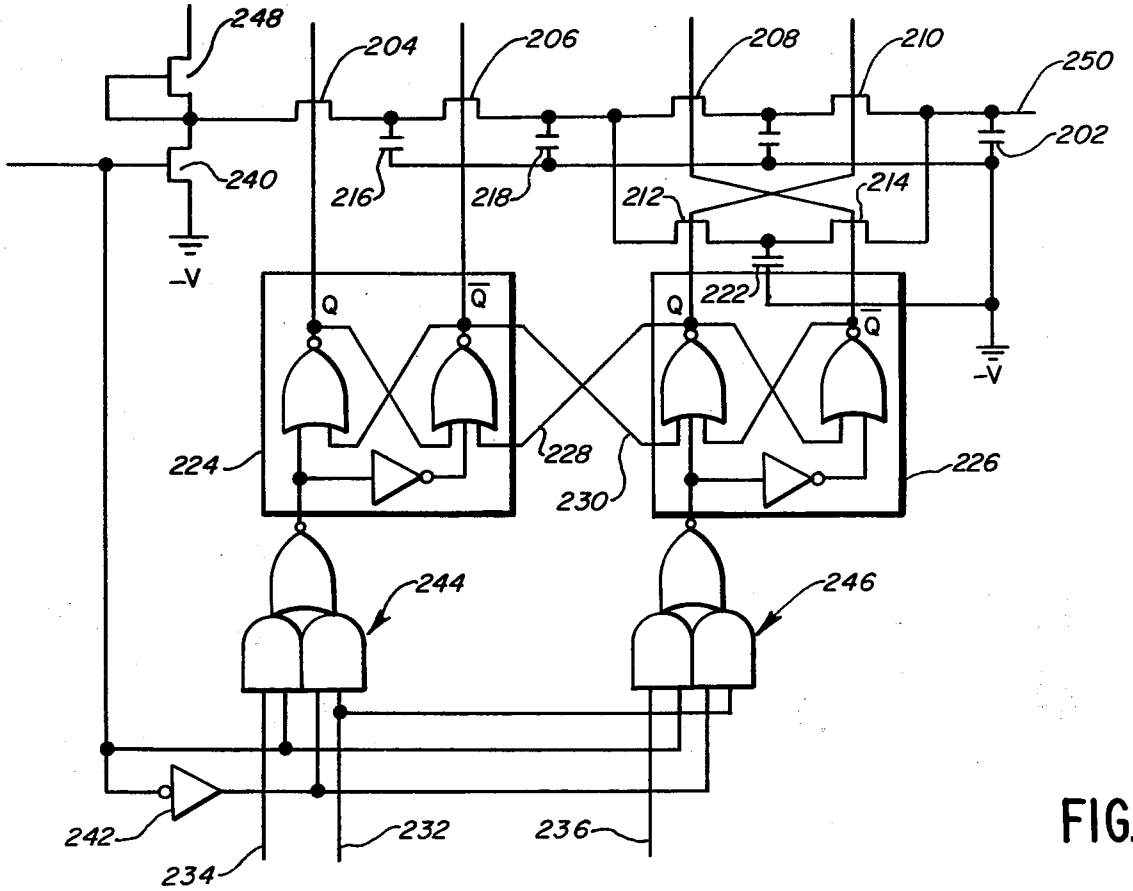
FIG. 2 is a schematic diagram of a sustain time constant circuit incorporating switched capacitors.

FIG. 2 shows an integrated time constant circuit utilizing switched capacitor techniques. The time constant circuit comprises a capacitor 202 which is charged or discharged through a simulated resistor comprising metal oxide silicon field effect transistors (MOSFETs) 204 through 214 and the capacitors 216 through 222. The transistors 204 through 214 are driven by two flip-flop circuits 224 and 226 which are cross-coupled by the conductors 228 and 230 to ensure synchronization of switching when both flip-flop circuits are switched together.

The flip-flop circuits 224 and 226 are driven by a first clock signal provided on the conductor 232 during the attack portion of the keying waveform. During the decay portion of the keying waveform, the flip-flop circuit 224 is driven by a second clock signal provided on the conductor 234 and the flip-flop circuit 226 is driven by a third clock signal provided on the conductor 236. The frequency of the third clock signal is a multiple of the frequency of the second clock signal, e.g., eight times. An activating low voltage level signal is provided on conductor 36, refer to FIG. 1, to drive the transistor 240 into conduction. The inverter 242 together with the gating circuitry 244 and 246 provide for the alternate selection of the first clock signal or the second and third clock signals by the keyboard signal on the conductor 36. The transistor 248 is an integrated circuit equivalent of a low precision resistor.

If the time constant circuit of FIG. 2 is activated by a low signal on the conductor 36, a negative voltage $-V$ is passed to transistor 204 via the transistor 240. The low signal on conductor 36 also enables the clock provided on conductor 232 to drive the flip-flop circuits 224 and 226 via the gating circuitry 244 and 246, respectively. It will be presumed that the flip-flop circuits 224 and 226 are initially in their reset states, i.e., $Q=0$ or low and $\overline{Q}=1$ or high. Accordingly, during this clock phase, energy is transferred to the capacitor 216 via the transistor 204 which is activated by the Q output signal of flip-flop circuit 224. During this clock phase, energy is also transferred from the capacitor 218 to the capacitor 222 via the transistor 212 and from the capacitor 220 to the capacitor 202 via the transistor 210.

Upon the next transition of the clock signal provided on the conductor 232, the flip-flop circuits 224 and 226 are set, i.e., assume their set states Q=1 or high and $\overline{Q}$=0 or low, resulting in energy transfer from the capacitor 216 to the capacitor 218 via the transistor 206, energy transfer from the capacitor 218 to the capacitor 220 via the transistor 208 and energy transfer from the capacitor 222 to the capacitor 202 via the transistor 214. The frequency of the clock signal for the attack time provided on the conductor 232 is sufficiently high that the noise introduced into the signal on the output conductor 250 is insignificant. Accordingly, the same clock signals are used to drive both flip-flop circuits 224 and 226. The clock signals on the conductor 232 alternately perform the abovedescribed energy transfers to rapidly charge the capacitor 202 and thus simulate a charging resistor.

When the signal on conductor 36 goes to its high voltage level, the transistor 240 is placed in its non-conducting state, the flip-flop circuit 224 is driven by the second clock provided on the conductor 234 and the flip-flop circuit 226 is driven by the third clock provided on the conductor 236. During this time period which is the decay time for the envelope signal, energy is transferred from the capacitor 202 through the simulated resistor to ground through the transistor 248. The rapid switching of the transistors 208 through 214 between the capacitors 218 and 202 provides a plurality of energy transfer substeps for each energy transfer step between the capacitor 202 and the capacitor 216. For example, sixteen substeps are provided if the frequency of the third clock signal is eight times the frequency of the second clock signal. Sixteen substeps are provided rather than eight because of the double switched path provided by the capacitors 220 and 222 and the cross-coupling between the transistors 208 and 214 and the transistors 210 and 212. The substeps provide a smoothing effect for the large discrete energy transfer steps which would otherwise be provided by directly switching between the capacitors 216 and 202. This smoothing technique provides much better signal-to-noise ratio and is required for the lower switching frequency of the decay clock provided on the conductor 234.

The disclosed integrated time constant circuit utilizes switched capacitor techniques to simulate various resistance values to charge and discharge a capacitor. An attack waveform is provided by driving the capacitor switches with an attack frequency clock signal which is selectively provided to the switched capacitor circuit. A decay waveform is provided by driving the same integrated time constant circuit with a decay frequency clock signal, i.e., by changing the frequency at which the capacitor switches are operated. A second stage of switching is provided by the transistors 208 through 214 and the capacitors 220 and 222 to smooth the keying signal waveforms. This second stage of switching is effectively frequency doubled by cross-coupling the two switching paths to alternately activate those paths.

While only a single switched capacitor time constant circuit has been disclosed, this circuit will provide virtually any attack or decay time required by selection of the frequencies of the switching signals provided to the circuit. Modifications to this circuit to provide various special effects are possible by the addition of monopulsers, gating circuitry to selectively control the frequencies of the switching signals, etc. These modifications will not be described in detail since they are straight forward and involve the application of techniques well known to those of ordinary skill in the electronic organ art.

The integrated circuit package of the present invention can be electrically configured for use in two different organs, one referred to as a spinet organ and the other referred to as a console organ. The spinet organ has an upper manual and a lower manual, each manual containing forty-four keys. The lower manual is offset physically and frequency-wise from the upper manual by one octave of notes. The spinet organ also has a thirteen pedal clavier; however, the signals from the foot pedal clavier are not processed by the integrated circuit package of the present invention.

For the spinet organ, the integrated circuit package shown in FIG. 1 is configured to provide a range of four octaves in the lower manual and four octaves in the upper manual, two alphabetic notes from the upper manual and two notes from the lower manual. For example, terminal 8 receives the input for the C note of the lowest octave of the upper manual, and input terminals 6, 4 and 2 receive the inputs for the C notes in the second, third and fourth octaves of the upper manual respectively. The input terminal 7 receives the C note of the lowest octave of the lower manual, while terminals 5, 3 and 1 receive the C note of the second, third and fourth octave of the lower manual respectively. The odd and even terminals 9 through 16 similarly correspond to four octaves of a second alphabetic note (e.g. C♯) from the upper and lower manuals. For historic reasons the upper and lower manuals contain only forty-four keys rather than forty-eight keys which would provide four complete octaves of each note. The terminals of the integrated circuit packages which correspond to the omitted notes are simply not used and left disconnected or connected to an appropriate nonuse potential.

The multiplexer 50 is provided with ten output terminals, 60 through 78 (see FIG, 3), even though there are only eight groups of time constant circuits in the envelope generator 34. The two extra terminals 68 and 78 are provided for the spinet organ and provide outputs for the lowest octave of notes on the lower manual since these notes do not correspond to like frequency notes in the upper manual and their keying signals must be routed to separate keying circuits. The signal routing for the lowest octave of the lower manual is more fully described hereinafter with reference to the multiplexer 50. Six integrated circuit packages in accordance with the present invention receive all keyboard input signals from the upper and lower manuals and generate time multiplexed keying envelope signals for the keying circuits of the spinet organ.

Console organs have an upper manual and a lower manual, each of which comprises sixty-one keys with the keys from the upper and lower manuals corresponding in frequency to one another. Console organs also have pedal claviers having thirty-two pedals. The integrated circuit package of the present invention can be electrically configured to provide six octaves of one note for both the upper and lower manuals and three octaves of the same note for the pedals. The keyboard input signals from the upper manual are provided to the odd numbered terminals 1 through 11 and the keyboard input signals from the lower manual are provided to the even numbered terminals 2 through 12. For example, the six octaves of C notes for the upper manual would be provided on terminals 1, 3, 5, 7, 9 and 11; and the six octaves of C notes for the lower manual would be provided on terminals 2, 4, 6, 8, 10 and 12. The remaining notes on the upper and lower manuals only comprise five octaves and therefore input terminals 11 and 12 are not utilized on the corresponding integrated circuit packages.

Terminals 13, 14 and 15 receive input signals from the three pedals which correspond to the common note which is provided by the IC package for both the upper and lower manuals. The pedal down signals are passed to the corresponding upper or lower sustain time constant circuits; however, those circuits are modified to provide a pedal time constant by changing the frequencies provided to those time constant circuits via the gating circuit 79 which is controlled by the spinet/console control signal on the conductor 58. Since the pedal notes correspond to the lower frequencies or lower octaves of the note provided by the particular integrated circuit package, the pedal envelope output signals must be provided to the keyer circuits which key those lower frequencies and are driven by the signals on output terminals 70, 60 and 62. This "re-routing" function is performed in the multiplexer 50 by conductors 80, 82, 84 and a fourth time slot which corresponds to the pedal outputs and will be described hereinafter with reference to the multiplexer 50. To conserve terminals on the integrated circuit package, the pedal clock is provided on keyboard input terminal 16 to drive the pedal clock phase generator circuit 44*e* of the clock phase circuits 44. The pedal clock signal does not interfere with the operation of the organ since the corresponding output terminal 78 of the multiplexer 50 is not connected for a console organ.

The switch matrix 32 provides selective connections for the keyboard input signals on the terminals 1 through 16 and the harmony output signals on the conductors 28 to the time constant circuits of the envelope generator 34. Pairs of the input terminals, one odd numbered and one even numbered, are associated together and connected to three associated time constant circuits 38, 40, 42 via the switch matrix 32. The odd numbered input terminals are connected to the upper sustain time constant circuits 42 and the even numbered terminals are connected to the lower sustain time constant circuits 38. Either odd or even numbered terminals can be connected to the percussion time constant circuits 40 in response to control signals transmitted on the conductors 22. An "upper manual to percussion" signal is provided on one of the conductors of the conductor group 22 and controls the switch matrix to connect the odd numbered terminals to the percussion time constant circuits 40. When so connected the upper manual keyboard signals control not only the upper sustain time constant circuits 42 but also the percussion time constant circuits 40.

A "lower manual to percussion" signal is provided on a second conductor of the conductor group 22 to selectively connect the even numbered terminals to the percussion time constant circuits 40. This allows the lower manual keyboard signals to control both the lower sustain time constant circuits and the percussion time constant circuits. The integrated circuit package allows both the "upper manual to percussion" signal and "lower manual to percussion" signal to be active at the same time, in which case both manuals control the percussion time constant circuits 40. However, organs utilizing this integrated circuit package preferably provide an interlocking switch such that either the "upper manual to percussion" signal or "lower manual to percussion" signal, but not both, can be active at one time.

Signals from the harmony circuit 28 are switched to the various time constant circuits in accordance with the control signals on the other two of the four conductors in the conductor group 22. The harmony signals are connected to the upper sustain circuits if a "harmony to upper manual" control signal is activated and/or the harmony signals are connected to the percussion time constant circuits if a "harmony to percussion" signal is activated.

The signals provided on the two conductors of the conductor group 20 provide for transferring the pedal signals to the lower manual and for controlling the switch matrix 32 to electrically configure the package for a spinet organ or console organ. The "pedals to lower manual" signal switches the pedal inputs on the terminals 13, 14, and 15 in the case of a console organ to the lower sustain circuits 38 for the lowest three tones such that the pedals are equivalent to playing the lower manual for those three notes. This signal has no effect on spinet organs due to the "spinet/console" signal.

The control signal provided on the conductor 19 is a piano sustain signal. The piano sustain signal is routed to the percussion time constant circuits and controls gating circuits similar to the gating circuitry 224, 246 shown in FIG. 2 to select appropriate switching frequencies for the percussion time constant circuits to accurately simulate the attack and decay times for a piano.

Figure 3:
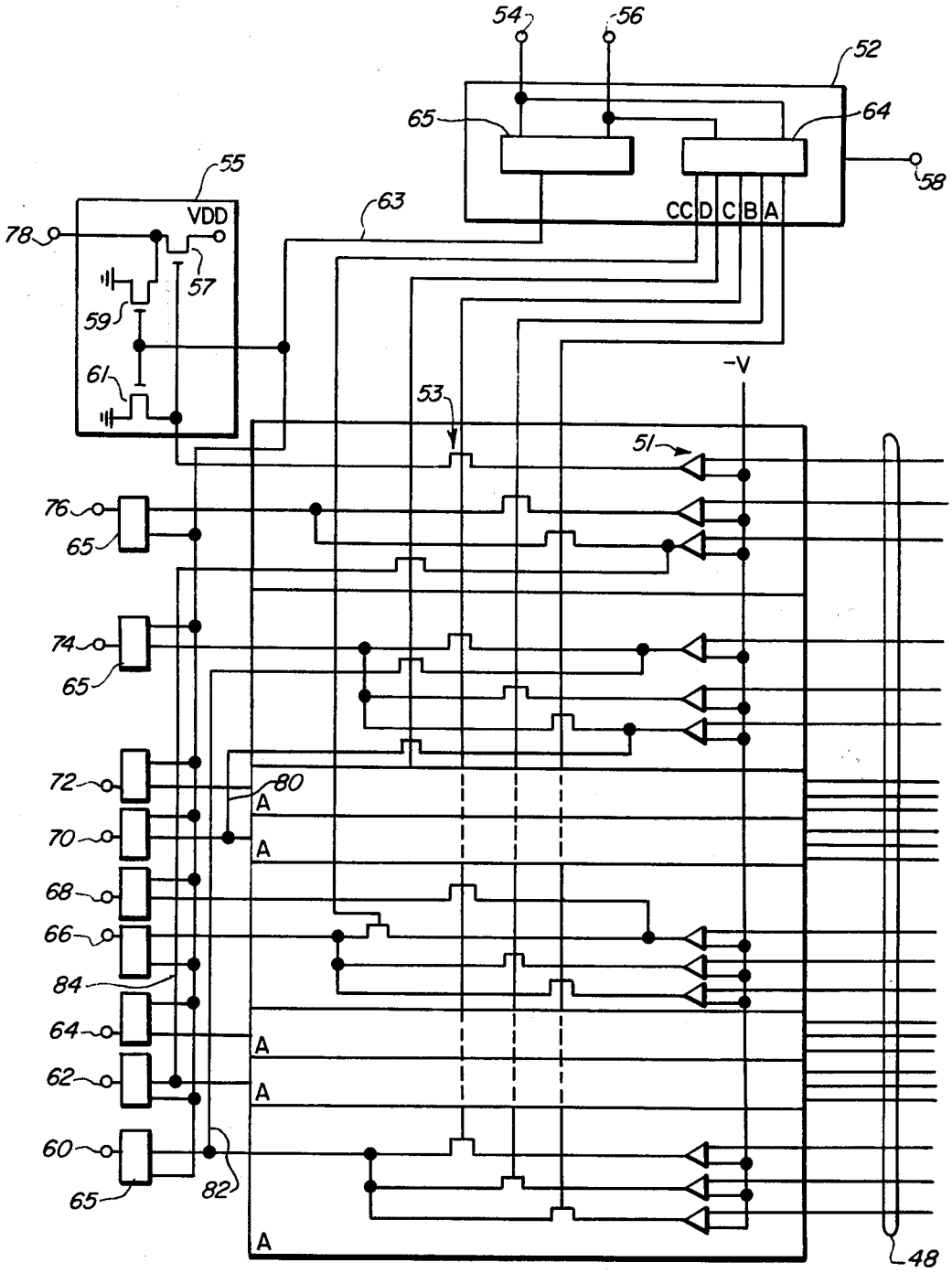
FIG. 3 is a schematic diagram of the multiplexer of FIG. 1.

FIG. 3 shows a schematic diagram for the time division multiplexer 50 of FIG. 1. The multiplexer comprises an isolating circuit means, a coupling means and an output drive means to multiplex the input signals on the conductors 48 from the switch matrix 32 to the output conductors 60 through 78 which are connected to keying circuits.

The generator 52 which drives the multiplexer 50 receives two binary input signals on input terminals 54 and 56 from internal organ circuits to select various time constants as is well known to those of ordinary skill in the art. The binary inputs are decoded into four time slots or time phase signals designated A, B, C and D. The time phase signals A, B and C are provided for both the spinet and the console organs. Time phase signal D and a selectively activated time phase signal occurring simultaneously with time phase C and designated as time Phase CC are provided only for the console organ with the time phase CC being provided on a separate conductor. Gating circuitry in the generator 52 provides the phase signals D and CC for a console input on the conductor 58 but does not provide those time phase signals for a spinet input on the conductor 58. The spinet/console signals are received on the input terminal 18 and decoded by the serial to parallel data converter 24 and applied on conductor 58.

The outputs of the envelope generator 34 are multiplexed by the time division multiplexer 50. During time phase A, the output signals from the upper sustain time constant circuits 42 are passed to the output terminals 60 through 66 and 70 through 76. Similarly, during time phase B, the output signals from the percussion time constant circuits 40 are passed to the terminals 60 through 66 and 70 through 76. Time phase C gates the output signals from the lower sustain time constant circuits 38 to the output terminals 60 through 64, 68 through 74 and 78. This arrangement is necessary since the lower octave of the lower manual of the spinet organ has no corresponding frequency range on the upper manual and therefore the keying envelope for the lower sustain time constant of this lower manual octave must be sent to a separate keyer via terminal 68. The same is of course necessary for the second alphabetic note via terminal 78.

For a console organ, time phase signal CC gates the output signals from the corresponding lower sustain time constant circuit to output terminal 66. In a console organ, time phase D is also provided to gate the pedal signals from the time constant circuits corresponding to pedals 1, 2 and 3 received on input terminals 13, 14 and 15 to the output terminals 70, 60 and 62 via the conductors 80, 82 and 84, respectively. In the preferred embodiment the output terminal 70 corresponds to the lowest octave of the console organ, terminal 60 corresponds to the second octave and terminal 62 corresponds to the third octave, and accordingly keying enveloped time constants signals for the pedal octaves 1, 2 and 3 should be provided at these outputs. This arrangement also facilitates interfacing with the harmony circuit. The pedal clock signal for the console organ is provided on terminal 16 and passed through the switch matrix 32 to the corresponding lower sustain time constant circuit 38 and to the multiplex circuit 50 where the signal is passed to output terminal 78 during phase C of the time multiplex phasing. However, in the console organ, terminals 68 and 78 are not connected and accordingly, the signal generated in response to the pedal clock signal has no effect. For simplicity the entire multiplex circuit is not shown but instead similar circuit groups labeled "a" are shown in block from wherever possible.

It is important to fully buffer the storage capacitor in the switched capacitor cell of FIG. 2, so that when the coupling transistors of FIG. 3 are driven by output A, B, C, CC or D the charge on the storage capacitor in the switched capacitor cell is not affected. The outputs on conductor 48 from FIG. 2 are each connected to a isolation circuit comprising a plurality of unity gain amplifier 51. Each unity gain amplifier 51 has very little DC loss and it fully buffers the storage capacitor in the switched capacitor cell from the coupling transistor following the unity gain amplifier.

The coupling circuit comprises a plurality of transistors 53 and each coupling transistor 53 feeds an output drive circuit 55. The output drive circuit 55 comprises a source follower 57 connected to a voltage VDD, and a transistor switch 59 connected to ground and a second transistor switch connect to ground and the gate of source follower 57. When there is a delta change between the AB inputs at terminals 54 and 56 to the generator 42 the detector 65 provides an output pulse on conductor 63. The transistor switch 61 also receives the pulse on conductor 63 which pulls the gate electrode of source follower 57 to ground potential thus fully shutting off the source follower during the pulse. The transistor switch 61 also receives the pulse on conductor 63 and pulls the output at the terminal 78 to ground potential. This output circuit 55 is necessary since when any coupling transistor 53 turns off there may be a charge left on the output gate of source follower 57, therefore transistor 61 pulls the gate of source follower 57 to ground to assure that it is off. Also the input pulse on conductor 63 turns on transistor 59 and shorts the output voltage on line 78 to remove any remnant of the lost sample.

As is apparent from the above description, the IC package of the present invention provides a highly efficient package for generating the multiplexed keying envelope signals for electronic organs. In contrast to the prior art, integrated time constant circuits, multiple control functions and harmony generating circuitry are combined into a single IC package. A limited number of IC packages in accordance with the present invention are required per organ to considerably reduce the wiring and interconnection costs for the organ's production. Furthermore, the IC package is electrically configurable to be used in two types of electronic organs leading to higher volumes of IC packages utilized with resultant reduced cost per package.

While a preferred embodiment of this invention has been described, it will be understood that the invention is not limited to that embodiment. In view of the foregoing teachings, modifications will be apparent to those of ordinary skill in the art to which this invention pertains. Therefore, the appended claims are intended to cover any modifications and any other embodiments which constitute the salient features within the true spirit and scope of this invention.

What is claimed is:

1. An electronic musical instrument having a keyboard for generating a plurality of key down selection signals, controls means for generating a plurality of control signals and an integrated circuit package receiving said key down selection signals and said control signals for generating time multiplexed envelope keying signals, said integrated circuit package comprising:

switch matrix means receiving said key down selection signals and said control signals and for generating a plurality of time constant activation signals;

a plurality of integrated time constant circuits receiving said activation signals and for generating keying envelope signals; and multiplexer means receiving said keying envelope signals and having a plurality of output lines, and for time division multiplexing selected ones of said keying envelope signals into a plurality of time intervals on each of said plurality of output lines.

2. The integrated circuit package of claim 1 wherein said control signals are serially encoded and said package further comprises a serial to parallel converter circuit for receiving and converting said serially encoded control signals to a plurality of individual control signals, said switch matrix means receiving said individual control signals.

3. The integrated circuit package of claim 1 further comprising a generator means responsive to at least one of said control signals for selecting keying envelope signals from said time constant circuits in a sequence adapted for a console organ.

4. The integrated circuit package of claim 1 further comprising a generator means responsive to said at least one of said control signals for selecting keying envelope signals from said time constant circuits in a sequence adapted for a spinet organ.

5. The integrated circuit package of claim 3 or 4 wherein said multiplexer comprises:

isolation means for passing said keying envelope signals from said time constant circuits and for isolating said multiplexer from said time constant circuits;

coupling means for receiving said keying envelope signals from said isolation means and passing selected ones of said keying envelope signals; and, output means for receiving said selected one of said keying envelope signals for connection to corresponding keyer circuits.

6. The integrated circuit package of claim 5 wherein said generator means provides a plurality of switching signals at separate time slots; and, said coupling means comprises a plurality of switching elements responsive to said switching signals for passing different keying envelope signals at separate time slots.

7. The integrated circuit package of claim 6 wherein said plurality of switching elements are arranged into a plurality of groups, each group corresponding to an octave range on said keyboard.

8. The integrated circuit package of claim 7 wherein at least some of said groups are interconnected to pass the keying envelope signals received by one group to the output terminal of another group.

9. The integrated circuit package of claim 1 wherein said multiplexer comprises:

isolation means for passing said keying envelope signals from said time constant circuits and for isolating said multiplexer from said time constant circuits;

coupling means for receiving said keying envelope signals from said isolation means and passing selected ones of said keying envelope signals; and, output means for receiving said selected one of said keying envelope signals for connection to corresponding keyer circuits.

* * * * *